United States Patent [19]

Czajkowski et al.

[11] 3,972,290

[45] Aug. 3, 1976

[54] FLYWHEEL TYPE ODOMETER SAFING AND ARMING MECHANISM

[75] Inventors: Norman Czajkowski, Chevy Chase; William J. Donahue, Takoma Park; James M. Douglas, Silver Spring; Thomas A. Cammack, Beltsville, all of Md.

[73] Assignee: The United States of America as represented by the Secretary of the Navy, Washington, D.C.

[22] Filed: July 28, 1975

[21] Appl. No.: 599,806

[52] U.S. Cl. ..... 102/79; 102/83

[51] Int. Cl.[2] ..... F42C 15/22

[58] Field of Search ..... 102/83, 84, 79, 80

[56] References Cited

UNITED STATES PATENTS

| | | | |
|---|---|---|---|
| 1,915,890 | 6/1933 | Junghans | 102/83 |
| 2,190,157 | 2/1940 | Junghans | 102/83 |
| 2,421,859 | 6/1947 | Whitney | 102/79 X |
| 2,789,508 | 4/1957 | Rove et al. | 102/83 |
| 3,368,487 | 2/1968 | O'Connor et al. | 102/83 X |
| 3,547,034 | 12/1970 | Popovitch et al. | 102/84 X |
| 3,580,177 | 5/1971 | Krahulec | 102/79 |
| 3,670,655 | 6/1972 | Krupa | 102/83 X |

FOREIGN PATENTS OR APPLICATIONS

| | | | |
|---|---|---|---|
| 572,725 | 3/1959 | Canada | 102/79 |

*Primary Examiner*—David H. Brown

*Attorney, Agent, or Firm*—R. S. Sciascia; J. A. Cooke; F. K. Yee

[57] ABSTRACT

A fail-safe projectile fuze safety-and-arming mechanism comprises a rotor having thereon an explosive train component, said rotor having its mass center on the projectile spin axis. Fixedly secured to the rotor is a pinion whih engages first and second drive gears provided with clearance spaces on the circumference thereof, wherein a plurality of gear teeth have face dimensions less than the thickness of the gears. The mass centers of the drive gears are offset from the geometric centers thereof. Engagement is continuous between each of the drive gears but, because of the clearance spaces, is intermittent between the drive gears and the pinion. Rotation of the rotor is controlled by the position and dimensions of the clearance spaces. A locking ball positioned in a raceway between the rotor and the housing of the device prevents undesired movement of the rotor. For a selected projectile launcher and a selected elevation angle of launch, a constant, predetermined arming distance is achieved with the present arming mechanism irrespective of the linear velocity of the projectile.

10 Claims, 7 Drawing Figures

FLYWHEEL TYPE ODOMETER SAFING AND ARMING MECHANISM

BACKGROUND OF THE INVENTION

The present invention relates to a fuze safety-and-arming devices, and more particularly to a fuze safety-and-arming device for spin-stabilized projectiles, the device having a plurality of novel, rotary movements to arm the fuze.

Safety and arming devices, which in themselves have no target detecting capability, are used in spin-stabilized projectile fuzes to keep the fuze in the safe condition until the projectile has been launched and has travelled a safe distance from the launcher, after which the devices arm and are ready to detonate the projectile whenever the fuze firing signal is generated. These devices generally comply with disign safety requirements by providing the required safety in the logistics life of a fuze from manufacture through launch. However, these type devices, which usually depend on an explosive train interrupter or rotor having its center of mass displaced from its rotational axis and this axis displaced from the axis of projectile spin to supply arming torque under a spin environment, have a common inherent weakness in being non-fail-safe. Failure modes can be induced which could cause the devices to arm soon after launch and well before safe separation. Under these circumstances a close-aboard premature detonation may occur, depending upon the type of firing mechanism used in the target detecting fuze.

These potential failure modes reside in the timing mechanism that provides safe separation Under certain conditions of undected discrepant manufacture or abnormally severe launch shocks, it is possible for the safe separation timer to fail in such manner as to cause it to disengage and allow the device to arm essentially instantaneously after gun exit. Some state-of-the-art safety-and-arming (S & A) devices incorporate pseudo fail-safe or premature-trap mechanisms which provide some protection against these failure modes. However, such mechanisms are not fully effective. In general, the state-of-the-art S & A devices do not completely satisfy the design goal of a truly fail-safe mechanism.

Consequently, a need exists for an S & A device with fail-safe characteristics inherent in the nature of its design concept. Such a concept would therefore be less vulnerable to discrepant manufacture and unforeseen environmental effects, and less dependent on auxiliary safety mechanisms with safety failure modes within themselves.

The present invention overcomes the above-discussed drawbacks by providing an odometer-type S & A mechanism which employs a balanced roter pivoted about its center of mass, the pivot being collinear with the projectile spin axis. The rotor thus becomes inertially passive in a constant spin environment. Centrifugal force exerts no driving torque on the rotor and will not drive it to the armed position if the rotor should disengage from the arming gear train. In such case, a fail-safe condition, or dud, results. This principle is totally different from the prior art odometer S & A mechanisms which utilize the rotation of an off-balanced rotor.

SUMMARY OF THE INVENTION

Accordingly an object of the present invention is to provide a fail-safe projectile fuze arming mechanism.

Another object of the present invention is to provide a projectile fuze arming mechanism which is relatively unaffected by errors in the manufacture thereof.

Another object of the present invention is to provide an easily programmed projectile fuze arming mechanism.

Yet another object of the present invention is to provide a fail-safe fuze arming mechanism which delays arming for a predetermined distance regardless of projectile linear velocity variations.

Still another object of the present invention is to provide an arming mechanism which produces a safe failure rather than an unsafe failure in the event of component structural failure.

Briefly, these and other objects of the present invention are attained in a fail-safe fuze arming mechanism for spin stabilized projectiles which comprises a rotor having thereon a component of an explosive train and a pinion fixedly secured to the rotor pivot axis. Meshingly engaging the pinion are two drive gears having geometric centers offset from the mass centers. The drive gears each comprise at least one clearance space positioned on the circumferences of the gears, the clearance spaces having a plurality of gear teeth with face dimensions less than the thickness of the gear. The clearance space allows the drive gears to continuously engage each other while intermittently engaging the pinion gear, causing the arming rotor to rotate first in one direction a predetermined angular displacement and then in the other direction a predetermined angular displacement to align the explosive components in the armed position.

BRIEF DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein.

DESCRIPTION OF THE PREFERRED EMBODIMENT

Figure 1:
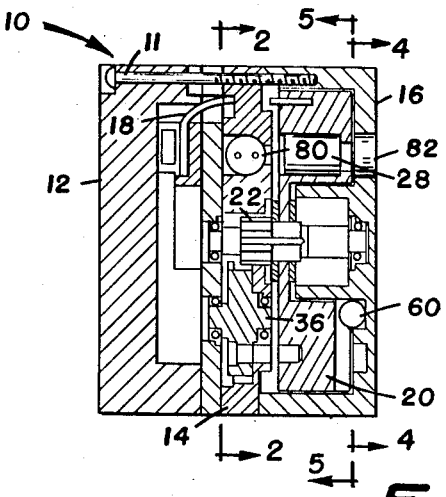
FIG. 1 shows an embodiment of the odometer safety-and-arming device of the present invention in the assembled condition.

Referring now to the drawings wherein like reference numerals designate corresponding parts throughout the several views, there is shown in FIG. 1 an embodiment of a fail-safe, odometer-type safety-and-arming device 10 of the present invention, adapted to be installed, for example, into a projectile fuze and designed to arm the fuze after a predetermined projectile travel distance regardless of projectile speed. The components of the arming device 10 are shown assembled, as by screws 11 (one shown), and include a spacer 12, drive gear housing 14, rotor 20 and a rotor housing 16. Some of the ancillary equipment normally associated with a safety-and-arming device have not been shown to enhance the clarity of the drawing. This equipment is known in the art and need not be elaborated upon herein.

Spacer 12 provides a cover for the electrical leads 18 and permits spatial compatability between the safety-and-arming device 10 and the fuze. The illustrated arming mechanism is of the explosive train type wherein a detonator 80 is received in the drive gear housing 14 and a booster lead-in 82 is positioned in rotor housing 16, these components being interrupted by the rotor 20. The detonator and the booster lead-in are in alignment, but are shielded from each other by the rotor when the rotor is in the safe position (see FIG. 2*a*). Rotor lead 28 is shown displaced to the armed position in FIG. 1.

Figure 3:
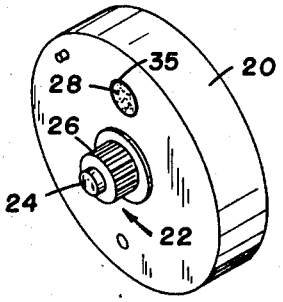
FIG. 3 is a perspective view of the arming rotor.
Figure 2A:
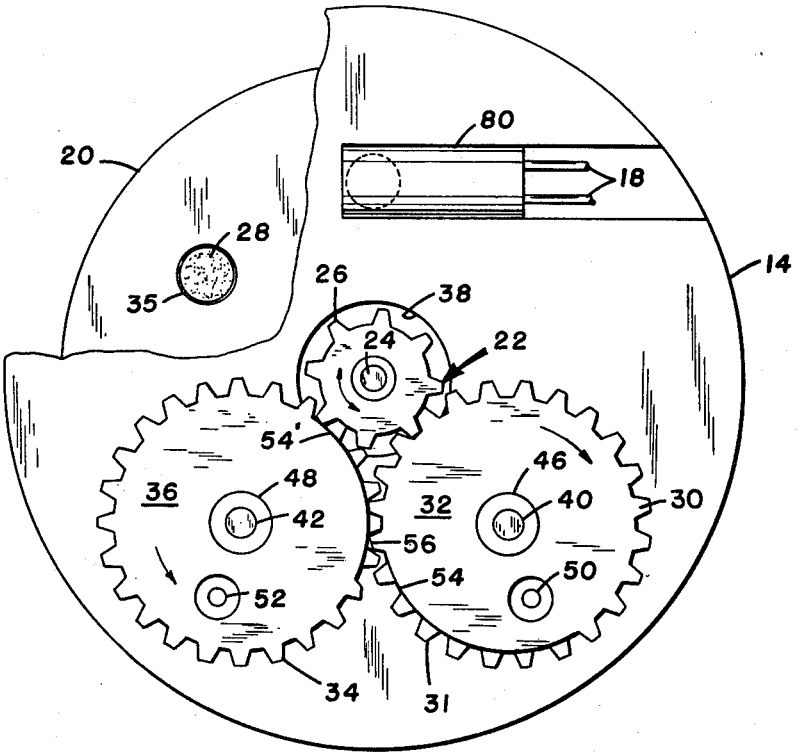
FIG. 2*a* is a view along line 2—2 of FIG. 1 showing the drive mechanism of the device with the arming rotor in the safe position.

FIG. 2*a* is taken along the view line 2—2 of FIG. 1 and shows on the enlarged scale the driving mechanism of the arming device 10. The rotor 20, having thereon a pinion gear 22 fixedly mounted at or near the geometric center by means of a shaft 24, rotatably abuts one face of the drive gear housing 14 (see FIG. 1). Rotor 20 is shown by itself in the perspective view of FIG. 3. Rotor lead 28, a component of the explosive train, is received within a bore 35. Drive gear housing 14 has a central bore 38 to receive pinion gear 22. Meshing with teeth 26 of pinion 22 are teeth 30 of a first drive gear 32 and teeth 34 of a second drive gear 36. Drive gears 32 and 36 are rotationally mounted on the projectile in the housing 14 by mounting shafts 40 and 42. The drive gears are supported on the shafts 40 and 42 by bearing housings 46 and 48, respectively. Mounting shafts 40 and 42 are located at the geometric center of the drive gear; however, to insure rotational motion of the drive gears the center of gravity of each gear is displaced from the geometric center by means known in the art, such as material removal or the use of different density materials. For illustrative purposes material has been removed from the gears 32 and 36 in FIG. 2, as denoted by cut-out portions 50 and 52, respectively. Thus, because of the eccentric center of gravity, centrifugal force generated by rotation of the projectile imparts rotation to the drive gears.

While both drive gears 32 and 36 have been shown to have offset centers-of-gravity (c.g.), only one gear need be so provided to initiate the arming process upon rotational motion of the projectile. With both gears having offset c.g., then any lateral shock on the arming device will cause the gears to rotate in a counteracting fashion, effectively negating the effect of the shock. The location of the c.g., in FIGS. 2*a* and 2*b* are such that centrifugal force on the arming device 10 insures proper rotational direction of the drive gears.

Figure 2B:
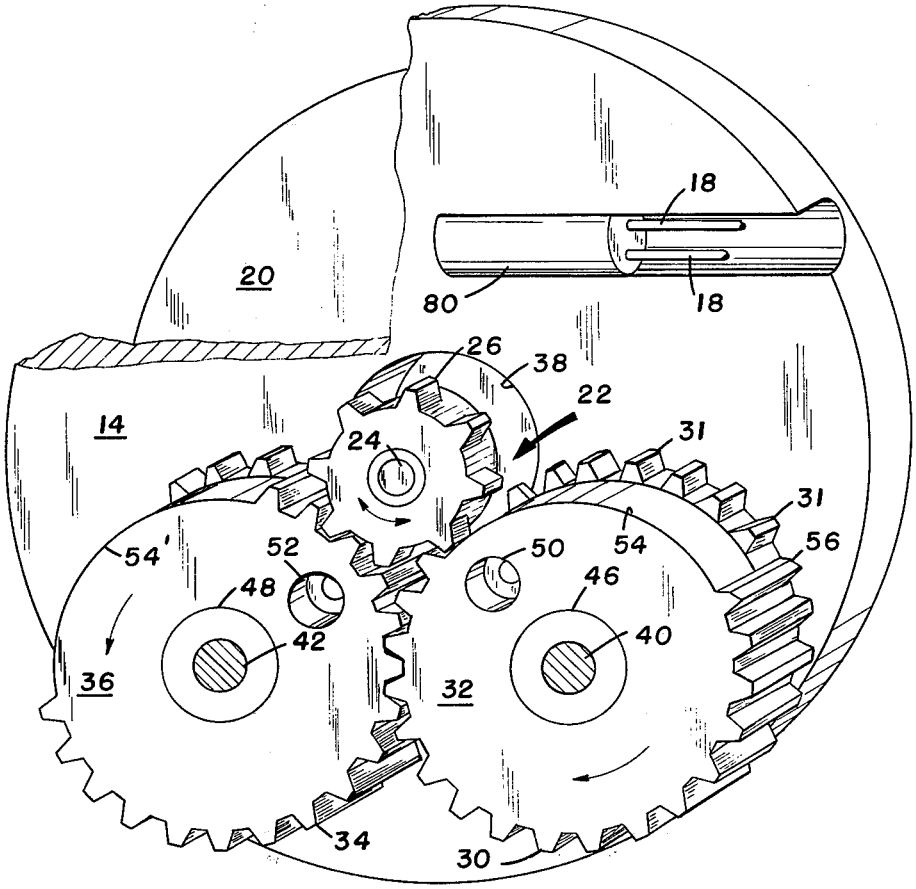
FIG. 2*b* is a perspective view of FIG. 2*a* with the arming rotor in the armed position.

As shown in the perspective view of FIG. 2*b*, the face dimension of the gear teeth 30 and 34 are such that when the drive gears and pinion gear are mounted, teeth of the gear 32 or gear 36 will remain meshed with the teeth 26 of the pinion gear. Thus, only one of the two drive gears will be imparting rotation to the pinion gear at any given time. In the final armed position of the rotor shown in FIG. 2*b*, both drive gears are meshed with each other and with the pinion gear; thus, there is no further rotor movement. Correspondingly, in the initial rotor position of the firing sequence shown in FIG. 2*a*, the drive and pinion gears are meshed so as to prevent any rotor movement except that in the direction of the arming sequence. Drive gears 32 and 36 are similar, and therefore the following discussion is equally applicable to both. Positioned on the circumference of the drive gear 32 is a clearance space 54 having a plurality of gear teeth 31 with face dimensions less than the thickness of gear. The term "face" as used herein is defined to mean the width of the tooth surface, measured parallel to the axis of the gear. Gear clashing is prevented by providing the drive gear with a foreshortened gear tooth, such as 56 adjacent the clearance space 54. The clearance space 54 on gear 32 and a corresponding space 54' on gear 36 permit the two drive gears to continually engage each other by means of the gear teeth while intermittently disengaging pinion 22 by means of the spaces. Thus, by properly selecting the dimensions and placement of the clearance spaces on the drive gears, the motion imparted to rotor 20 can be controlled. A plurality of clearance spaces on each of the drive gears can also be used to drive rotor 20 accordingly. For example, if clearance space 54 covers an approximate angle of 80° on drive gear 32 and the corresponding clearance space 54' covers an approximate angle of 60° on the drive gear 36, rotor 20 will undergo a counterclockwise rotation of 150° followed by a clockwise rotation of 210°. Other rotor movements may include several counterclockwise and clockwise rotations covering a total rotor rotation of several hundred degrees. The rotor 20 thus interrupts the firing train between the detonator 80 and the booster lead-in 82. When the rotor has completed the preselected rotation cycle, rotor lead 28 will be brought into alignment with the detonator and the booster lead-in, thus aligning the explosive train and arming the projectile.

Figure 4:
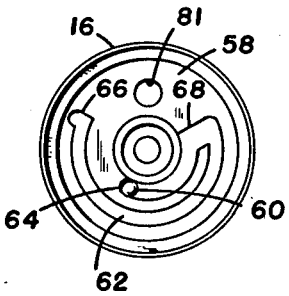
FIG. 4 is a view along line 4—4 of FIG. 1.
Figure 5:
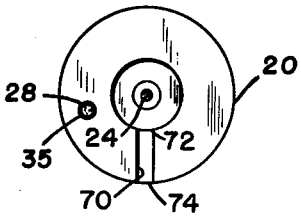
FIG. 5 is a view along line 5—5 of FIG. 1.

A further fail-safe aspect is provided the design of the arming device 10. Shown in FIG. 4 is the inner end surface 58 of rotor housing 16, as seen from line 4—4 of FIG. 1. A locking ball 60 is positioned in raceway 62 provided with ends 64 and 66 and a transfer track 68. End 66 is enlarged to contain the ball 60 and prevent further movement thereof. Also visible in FIG. 4 is the bore 81 in the rotor housing 16 to receive the booster lead-in 82. Shown in FIG. 5 is the back of the rotor 20 as viewed from line 5—5 of FIG. 1. The rotor back is provided with a radial slot 70 wherein ball 60 rides as the rotor turns. At the beginning of the arming sequence, ball 60 is positioned at end 64 of the raceway 62 and matingly engages the slot at the base 72 thereof. Transfer track 68 is positioned in raceway 62 to coincide with the rotation reversal of rotor 20. As the ball moves outward in the transfer track 68, it also moves in slot 70, from base 72 toward top 74. Thus, at the end of the arming sequence, ball 60 is at end 66 of the raceway and at top 74 of the rotor slot. The rotor is thus locked against further rotation past the armed position by the locking ball 60 and by the simultaneous engagement of pinion 22 by the gears 32 and 36. Furthermore, the meshing engagement between the rotor 20 and housing 16 via ball 60 precludes relative rotation therebetween.

Figure 6:
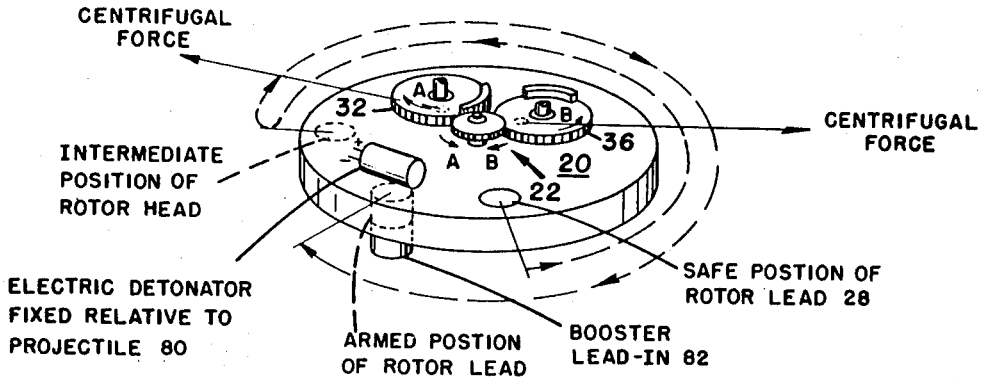
FIG. 6 is a schematic of the rotation of the arming rotor.

The operation of the arming mechanism 10 may be seen by reference to the schematic of FIG. 6. During handling and prior to launch, the rotor 20 is secured in the safe position by means known in the art, such as safety detents and setback lock means. After the projectile has left the launcher, it acquires a rotational motion about its longitudinal axis. Since the gear shafts 40 and 42 are fixed relative to the projectile, centrifugal force acts through the offset center of gravity of the gears 32 and 36 to impart a rotation thereto in the direction of the arrows to initiate the arming process.

The position of the locking ball 60 relative to the raceway 62 and slot 70 and the location of the gears' c.g. relative to the shafts ensure proper rotation of the gears. From the initial, safe position of FIG. 2*a*, wherein rotor lead 28 is out of alignment with detonator 80, gear 32 rotates clockwise, and since gear 36 is meshing therewith causes gear 36 to rotate counterclockwise (note arrow with letter A). At this juncture pinion 22 is adjacent the clearance space 54' on gear 36; therefore, there is no contact between these elements and only drive gear 32 is imparting motion to pinion 22 causing it to rotate counterclockwise. Since pinion 22 is fixed relative to the rotor 20, the rotor also rotates counterclockwise a predetermined distance, as indicated by the broken lines in FIG. 6. FIG. 2*a* is the view as seen by looking "down" on FIG. 6. The rotor lead 28 is displaced from the safe position to the intermediate position shown in FIG. 6, at which time pinion 22 is adjacent the clearance space 54 of gear 32, thereby disengaging from gear 32 and simultaneously engaging gear 36 to commence a clockwise rotation (letter B). In the armed position, as shown in FIG. 2*b*, both drive gears 32 and 36 simultaneously engage pinion 22 to prevent further rotation of rotor 20, with the rotor lead 28 in line with the detonator 80, supported on the gear housing 14 and fixed relative to the projectile, and with the booster lead-in 82, also fixed relative to the projectile. At this point the fuze is armed and ready to be suitably detonated. The rotation of the drive gears is controlled so that the arming sequence is completed after the projectile has reached the desired separation distance. The device shown in the figures is armed at the completion of the rotational movement imparted by second drive gear 36; however, other combination of movements can be used to arm the device. Movement of the rotor past the armed position is prevented by locking ball 60 abutting end 66 of raceway 62 to prevent further rotational movement of rotor 20.

The rotation of the drive gears, and hence the arming of the projectile, is dependent upon the distance travelled by the projectile before fuze arming. This arming distance is a function principally of the velocity with which the projectile exits the gun muzzle, which exit velocity, in turn, determines the rate of spin for the projectile. The rate of projectile spin determines the rate of rotation for the drive gears and hence the rotor. Thus, the arming distance for a given projectile launcher and a selected elevation angle of launch will be substantially constant while the arming time may vary as a function of projectile linear velocity.

There has thus been disclosed a unique fail-safe fuze arming mechanism controlled by projectile rotational motion. The novel series of counterrotary motion of the arming rotor precludes the possibility of the rotor prematurely passing the armed position that exists in single-rotary-motion arming mechanisms. By properly designing and positioning the clearance spaces on the drive gears, proper rotor displacement is controlled and the desired separation distance is achieved.

Because the gears are all locked at the beginning and end of the arming sequence, the fail-safe design of the firing mechanism is enhanced. The sequence cannot be initiated until the projectile has been launched and spinning and will end only when the rotor, hence firing train, is in the exact position desired. Thus, premature arming will not occur.

Since the arming rotor is not controlled by stored energy but by energy derived from projectile rotational motion, any failure of the S & A arming mechanism prior to launch is in the safe mode, with the explosive train out of alignment. Thus malassembly of the mechanism, broken or missing components or mechanism malfunction will not cause the arming rotor to be rotated into the armed position.

Obviously numerous modifications and variations of the present invention are possible in light of the above teachings. For example, an alternative embodiment could have the drive gears located on the rotor to enhance packaging in which the pinion gear would be fixed to the cover plate of the gear housing or the rotor housing and would rotate relative to the rotor. Of course any number of motion reversals could be used to achieve the necessary arming distance. It is therefore to be understood that, within the scope of the appended claims, the invention may be practiced otherwise than as specifically discribed.

What is claimed as new and desired to be secured by Letters Patent of the United States is:

1. A safety-and-arming mechanism adapted for use in a projectile comprising:

an explosive firing train;

a rotor having means for completing said firing train;

a pinion gear fixedly attached to said rotor;

a first drive intermittently engaging said pinion gear and having a selected plurality of teeth with face dimensions less than the thickness of the gear;

a second drive gear engaging said first gear and intermittently engaging said pinion gear and having a selected plurality of teeth with face dimensions less than the thickness of the gear; and support means rotatably mounting said first and said second drive gears for meshing engagement with each other and with said pinion gear, whereby rotation of said drive gears displaces said rotor from an out-of-line, safe position to an armed position, with said means for completing said firing train in line with the other components of said firing train.

2. The arming mechanism of claim 1 wherein said rotor is angularly displaced by said pinion gear meshing with said drive gears.

3. The arming mechanism of claim 2 wherein said rotor is displaced counterclockwise when said first drive gear engages said pinion and clockwise when said second drive gear engages said pinion.

4. The arming mechanism of claim 3 wherein said support means contains a component of the firing train.

5. The arming mechanism of claim 4 wherein said drive gears have the mass centers displaced from the geometric centers such that projectile spin motion causes rotation of said drive gears.

6. The arming mechanism of claim 5 wherein said rotor is displaced a predetermined angular distance by engagement of said first drive gear with said pinion gear and a predetermined counterrotary angular distance by engagement of said second drive gear with said pinion gear.

7. The arming mechanism of claim 6 further comprising:

a radial slot on the surface of said rotor behind said pinion gear;

a housing for rotatably receiving said rotor;

an arcuate raceway on the inner end surface of said housing adjacent said slot; and a ball positioned in said raceway and matingly engaging said slot to control the angular displacement of said rotor.

8. The arming mechanism of claim 6 wherein said first drive gear displaces said rotor in a counterclockwise direction for an angular distance of 150° and said second drive gear displaces said rotor clockwise through an angular distance of 210°.

9. The arming mechanism of claim 7 further comprising a component of said firing train supported on said housing.

10. The arming mechanism of claim 9 wherein said means on said rotor for completing said firing train is an explosive element.

* * * * *